US009676212B2

(12) United States Patent
Nakano et al.

(10) Patent No.: US 9,676,212 B2
(45) Date of Patent: Jun. 13, 2017

(54) PRINTED MATERIAL, METHOD OF PRODUCING PRINTED MATERIAL, AND PRINTER

(71) Applicant: SCREEN HOLDINGS CO., LTD., Kyoto (JP)

(72) Inventors: Masayuki Nakano, Kyoto (JP); Kazushi Moriwaki, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/970,081

(22) Filed: Dec. 15, 2015

(65) Prior Publication Data

US 2016/0096383 A1 Apr. 7, 2016

Related U.S. Application Data

(62) Division of application No. 13/237,438, filed on Sep. 20, 2011, now Pat. No. 9,242,496.

(30) Foreign Application Priority Data

Sep. 29, 2010 (JP) ..... 2010-218101
Jul. 26, 2011 (JP) ..... 2011-163463

(51) Int. Cl.
*B41J 2/01* (2006.01)
*B41J 2/315* (2006.01)
(Continued)

(52) U.S. Cl.
CPC ..... *B41J 13/0009* (2013.01); *B41J 2/2117* (2013.01); *B41M 3/008* (2013.01);
(Continued)

(58) Field of Classification Search
CPC . B41J 11/002; B41J 2/2114; B41J 2/01; B41J 3/4073; B41J 11/00; B41J 11/0015;
(Continued)

(56) References Cited

U.S. PATENT DOCUMENTS 4,910,188 A 3/1990 Akada et al.
5,431,978 A 7/1995 Nakamura et al.
(Continued)

FOREIGN PATENT DOCUMENTS

EP 779614 A1 6/1997
EP 1052631 A2 11/2000
(Continued)

OTHER PUBLICATIONS

U.S. Office Action issued in U.S. Appl. No. 13/237,438 dated Feb. 17, 2015.
(Continued)

*Primary Examiner* — Kristal Feggins
(74) *Attorney, Agent, or Firm* — McDermott Will & Emery LLP

(57) ABSTRACT

A printed material has a transparent base member, a first image layer formed on the base member, an intermediate layer formed on the first image layer, and a second image layer formed on the intermediate layer. The intermediate layer has a lower white background layer positioned above the first image layer, a light blocking layer positioned above the lower white background layer, and an upper white background layer positioned above the light blocking layer. In the printed material, a thickness of the light blocking layer is uneven in conformity with undulation of the first image layer, and therefore a surface of the intermediate layer which is in contact with the second image layer is flat. With this structure, it is possible to prevent or suppress the undulation of the first image layer from appearing in the second image layer.

15 Claims, 14 Drawing Sheets

(51) Int. Cl.

| | |
|---|---|
| ***B41J 2/425*** | (2006.01) |
| ***B41J 13/00*** | (2006.01) |
| ***B41M 3/00*** | (2006.01) |
| ***B41M 5/00*** | (2006.01) |
| ***B41J 2/21*** | (2006.01) |
| *B41J 11/00* | (2006.01) |

(52) U.S. Cl.
CPC ..... *B41M 5/0047* (2013.01); *B41M 5/0064* (2013.01); *B41J 11/002* (2013.01); *B41J 11/0015* (2013.01); *Y10T 428/24868* (2015.01)

(58) Field of Classification Search
CPC ... B41J 2/315; B41J 2/435; B41J 2/21; B41M 1/34
See application file for complete search history.

(56) References Cited

U.S. PATENT DOCUMENTS

| | | | |
|---|---|---|---|
| 5,589,257 | A | 12/1996 | Carriker et al. |
| 5,671,211 | A | 9/1997 | Akashi et al. |
| 5,707,925 | A | 1/1998 | Akada et al. |
| 5,885,928 | A | 3/1999 | Hirano et al. |
| 6,113,149 | A | 9/2000 | Dukatz |
| 6,824,639 | B1 | 11/2004 | Hill et al. |
| 2004/0256754 | A1 | 12/2004 | Koguchi |
| 2005/0042399 | A1 | 2/2005 | Shiokawa et al. |
| 2005/0082162 | A1 | 4/2005 | Uno et al. |
| 2006/0021898 | A1 | 2/2006 | Shiokawa et al. |
| 2006/0158473 | A1 | 7/2006 | Mills et al. |
| 2007/0218318 | A1 | 9/2007 | Watanabe |
| 2009/0141615 | A1 | 6/2009 | Nakai et al. |
| 2009/0322814 | A1 | 12/2009 | Sano |
| 2010/0112223 | A1 | 5/2010 | Hill |

FOREIGN PATENT DOCUMENTS

| | | | |
|---|---|---|---|
| JP | 04209340 | A | 7/1992 |
| JP | 2010-005878 | A | 1/2010 |
| JP | 2010-118808 | A | 5/2010 |
| JP | 2011-164379 | A | 8/2011 |

OTHER PUBLICATIONS

U.S. Notice of Allowance issued in U.S. Appl. No. 13/237,438 dated Sep. 16, 2015.

PRINTED MATERIAL, METHOD OF PRODUCING PRINTED MATERIAL, AND PRINTER

RELATED APPLICATIONS

This application is a divisional of U.S. application Ser. No. 13/237,438, filed on Sep. 20, 2011, which claims priority to Japanese Patent Application No. 2010-218101 filed Sep. 29, 2010 and Japanese Patent Application No. 2011-163463 filed Jul. 26, 2011, the disclosure of which Applications are incorporated by reference herein.

TECHNICAL FIELD

The present invention relates to a printed material whose image can be visually recognized from both sides, a method of producing the printed material, and a printer.

BACKGROUND ART

Conventionally, printed materials in each of which images are printed on both sides of a base member have been widely used for advertisements, decorations, and the like. In a process of printing images on a front surface and a back surface of the base member, normally, after an image is printed on one of the surfaces, the base member is reversed and another image is printed on the other surface. For this reason, it is not possible to produce a printed material with high efficiency. Further, when it is intended to print images on both sides of a web-like base member, it is difficult to perform alignment of a plurality of images on a front surface and a plurality of images on a back surface.

Then, proposed is a technique in which two images are printed to be stacked on one of main surfaces of a transparent base member. Japanese Patent Application Laid Open No. 2010-5878 (Document 1) discloses a printed material in which a first layer, a second shielding layer, and a third layer are stacked in this order on one surface of a transparent film by an ink jet printer. The first layer and the third layer are formed of color ink and the second shielding layer is formed of white ink. In the printed material, by forming the second shielding layer, it is possible to prevent the third layer from being seen through when the first layer is visually recognized, and it is similarly possible to prevent the first layer from being seen through when the third layer is visually recognized. U.S. Patent Application Publication No. 2006/0158473 (Document 2) also discloses a printed material in which a first image, a white ink layer, and a second image are formed in this order on one surface of a transparent base member.

In a case where an image is printed on a transparent base member, since the amount of applied ink (the application amount of ink) varies with the gray level, there appears micro-undulation on a surface of the image depending on the kind of ink. As shown in Documents 1 and 2, in the techniques in which a plurality of image layers are stacked on one surface of the transparent base member, the undulation of the first image layer formed on a main surface of the transparent base member appears in the second image layer indirectly stacked on the first image layer. In a case where image layers are formed by discharging ultraviolet curable ink, particularly, the undulation of the first image layer becomes larger.

SUMMARY OF INVENTION

The present invention is intended for a printed material in which images can be visually recognized from both sides thereof, and it is an object of the present invention to prevent or suppress undulation of a first image layer from being visually recognized from a side of a second image layer.

According to the present invention, the printed material comprises a transparent base member, a first image layer formed on the transparent base member, an intermediate layer formed on the first image layer, and a second image layer formed on the intermediate layer, and in the printed material of the present invention, a surface of the first image layer which is in contact with the intermediate layer has undulation, and a thickness of the intermediate layer is uneven in conformity with the undulation and therefore a surface of the intermediate layer which is in contact with the second image layer is flat. By the present invention, it is possible to prevent or suppress the undulation of the first image layer from being visually recognized from a side of the second image layer.

According to a preferred embodiment of the present invention, the intermediate layer includes a light blocking layer having uniform color, and a thickness of the light blocking layer is uneven in conformity with the undulation of the first image layer and therefore a surface of the intermediate layer which is in contact with the second image layer is flat.

According to another preferred embodiment of the present invention, the first image layer, the intermediate layer, and the second image layer are formed of curable ink.

In this case, according to an aspect, the intermediate layer includes a light blocking layer, a thickness of the light blocking layer is uneven in conformity with the undulation of the first image layer and therefore a surface of the intermediate layer which is in contact with the second image layer is flat, and the light blocking layer is formed as a uniform mixed color image at least in an area in which the first image layer is not formed on the transparent base member. By this aspect of the present invention, even when the first image layer has undulation which cannot be extinguished by application of ink of one color, it is possible to easily extinguish the undulation.

According to another aspect, the first image layer contains normal ink of one color and light ink which has a color similar to the one color of the normal ink and has a density lower than that of the normal ink, the intermediate layer includes a light blocking layer, and the light blocking layer contains the normal ink and does not contain the light ink. It is thereby possible to increase the light blocking property of the light blocking layer.

The present invention is also intended for a method of producing a printed material. According to the present invention, the method comprises the steps of forming a first image layer having undulation on a transparent base member in accordance with first image layer data, generating intermediate layer data indicating an uneven thickness in conformity with the undulation, from the first image layer data, forming an intermediate layer on the first image layer in accordance with the intermediate layer data, the intermediate layer having a surface which is flat, and forming a second image layer on the intermediate layer in accordance with second image layer data.

The present invention is further intended for a printer. According to the present invention, the printer comprises an image forming part, a base member moving mechanism for moving a transparent base member relatively to the image forming part, and a controller for controlling the image forming part and the base member moving mechanism, and in the printer of the present invention, a first image layer having undulation is formed on a transparent base member in accordance with first image layer data, an intermediate layer whose surface is flat is formed on the first image layer in accordance with intermediate layer data, and a second image layer is formed on the intermediate layer in accordance with second image layer data by a control of the controller, and the controller comprises an intermediate layer data generator for generating the intermediate layer data indicating an uneven thickness in conformity with the undulation, from the first image layer data.

These and other objects, features, aspects and advantages of the present invention will become more apparent from the following detailed description of the present invention when taken in conjunction with the accompanying drawings.

DESCRIPTION OF EMBODIMENTS

Figure 1:
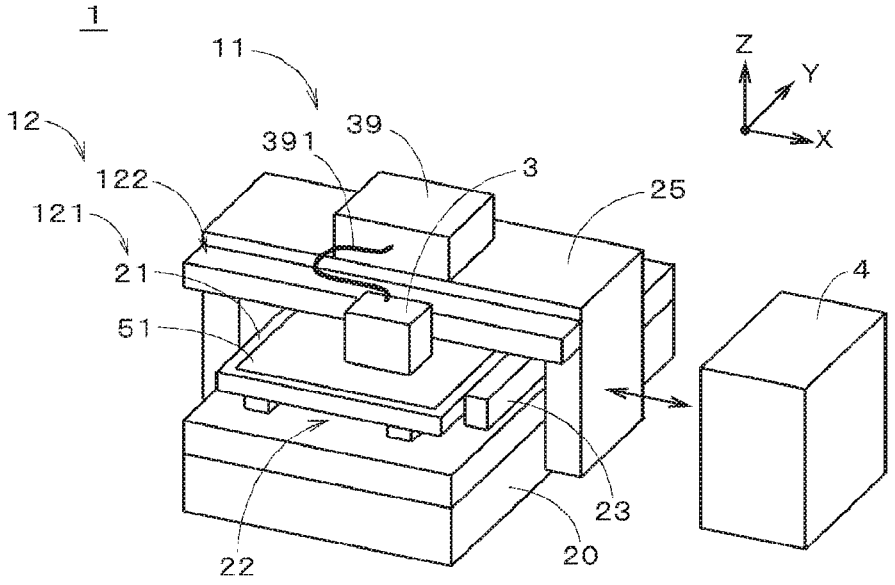
FIG. 1 is a perspective view showing a printer in accordance with a first preferred embodiment.

FIG. 1 is a perspective view showing an appearance of a printer 1 in accordance with the first preferred embodiment of the present invention. The printer 1 produces a printed material by printing an image on, for example, a film-like or plate-like transparent base member 51 formed of a resin, by ink jet method. Hereinafter, the transparent base member 51 is referred to simply as a "base member 51".

The printer 1 comprises an image forming part 11, a base member feeding mechanism 121, a head moving mechanism 122, and a controller 4. The controller 4 controls the image forming part 11, the base member feeding mechanism 121, and the head moving mechanism 122. The image forming part 11 comprises a head unit 3 for discharging droplets of ink toward a main surface (hereinafter, referred to as a "recording surface") on a (+Z) side of the base member 51 and a light source 39 for emitting ultraviolet rays. In FIG. 1, an X direction, a Y direction, and a Z direction are orthogonal to one another, and the (+Z) direction corresponds to an upper direction.

The base member feeding mechanism 121 comprises a base 20, a stage 21 which is provided on the base 20 and holds the base member 51 on an upper surface thereof, a stage moving mechanism 22 provided on the base 20, and a position detecting module 23 for detecting a position of the stage 21 relative to the base 20. A nut of a ball screw mechanism included in the stage moving mechanism 22 is fixed to a lower surface of the stage 21, and with rotation of a motor connected to the ball screw mechanism, the stage 21 smoothly moves along the Y direction in FIG. 1.

The base 20 is provided with a frame 25 bestriding the stage 21, and the head moving mechanism 122 is fixed to the frame 25. Above the stage 21, provided is the head unit 3, and the head unit 3 is supported movably in a scan direction (the X direction in FIG. 1) perpendicular to the Y direction and in parallel with the recording surface of the base member 51, by the head moving mechanism 122 having a ball screw mechanism and a motor. In the printer 1, a base member moving mechanism 12 for moving the base member 51 relatively to the head unit 3 in the Y direction and the X direction is constituted of the base member feeding mechanism 121 and the head moving mechanism 122.

The light source 39 is provided on the frame 25. Light from the light source 39 is introduced into the head unit 3 through a plurality of optical fibers (the optical fibers are actually in a bunch and represented by one heavy line with reference sign "391" in FIG. 1).

Figure 2:
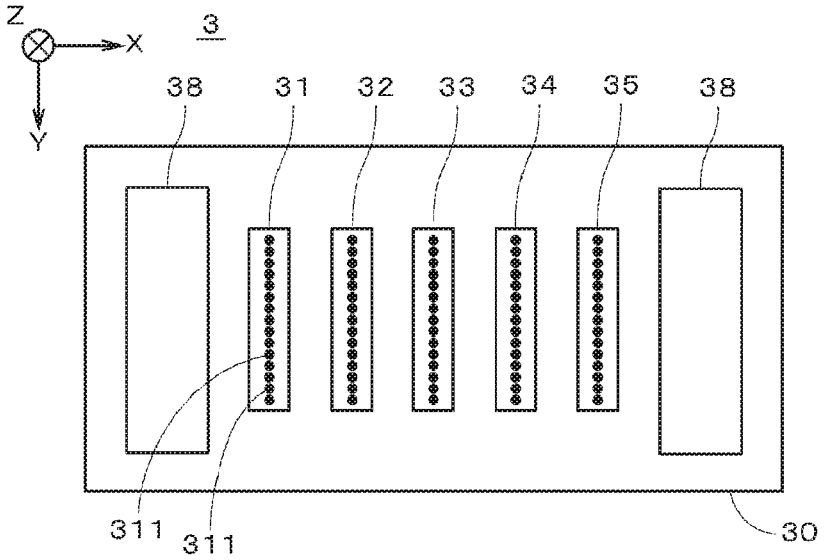
FIG. 2 is a bottom plan view of a head unit.

FIG. 2 is a bottom plan view of the head unit 3. The head unit 3 comprises a plurality of heads 31 to 35 for discharging ink of different colors, and the plurality of heads 31 to 35 are arranged in this order in the X direction and fixed to a body 30 of the head unit 3. In FIG. 2, a head 31 located outermost on the (−X) side discharges ink of C (cyan), a head 32 discharges ink of M (magenta), a head 33 discharges ink of K (black), a head 34 discharges ink of Y (yellow), and a head 35 located outermost on the (+X) side discharges ink of W (white).

In the following discussion, the ink (of C, M, K, and Y) discharged from the heads 31 to 34 is referred to as "color ink" in distinction from the white ink discharged from the head 35.

In each of the heads 31 to 35, a plurality of discharge ports (reference sign "311" is given to some of the discharge ports of the head 31) are arranged at a regular pitch in the Y direction, and ink is discharged from each of the discharge ports 311 toward the recording surface of the base member 51. The color ink and the white ink each contain an ultraviolet curing agent and have ultraviolet curability. Though 15 discharge ports 311 in each of the heads 31 to 35 are shown in FIG. 2, actually, each of the heads 31 to 35 has a large number of discharge ports 311.

The head unit 3 is provided with two light emitting parts 38 connected to the light source 39. The two light emitting parts 38 are so arranged as to sandwich the heads 31 to 35 in the X direction. In other words, the light emitting parts 38 are disposed on both sides of the heads 31 to 35 in the X direction. In each of the light emitting parts 38, a plurality of optical fibers are arranged in the Y direction, and ultraviolet rays are emitted by each of the light emitting parts 38 to a strip-like area extending in the Y direction on the base member 51. Therefore, when the head unit 3 moves in the (+X) direction, the ultraviolet rays are emitted from the light emitting part 38 provided on the (−X) side toward the ink immediately after being discharged onto the recording surface, and when the head unit 3 moves in the (−X) direction, the ultraviolet rays are emitted from the light emitting part 38 provided on the (+X) side toward the ink immediately after being discharged onto the recording surface. The ink discharged on the recording surface is thereby cured in a short time.

Figure 3:
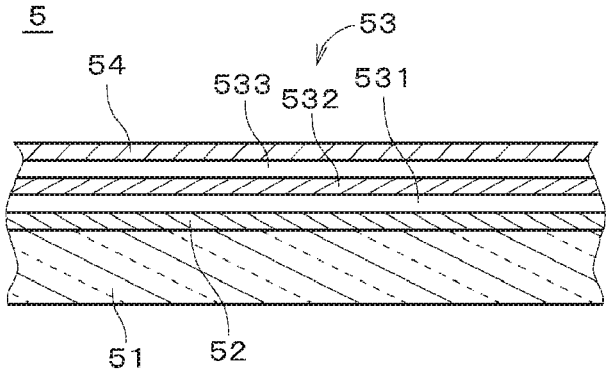
FIG. 3 is a cross section of a printed material.

FIG. 3 is a cross section of a printed material 5 produced by the printer 1. The printed material 5 comprises the transparent base member 51, a first image layer 52 formed on the recording surface of the base member 51, an intermediate layer 53 which is formed on the first image layer 52 and has a plurality of layers, and a second image layer 54 formed on the intermediate layer 53. In FIG. 3, respective thicknesses of these layers are exaggerated. Further, actually, as discussed later, thicknesses of part of these layers are uneven and in an area where no first image layer 52 is present, the base member 51 and the intermediate layer 53 are in contact with each other. The first image layer 52 and the second image layer 54 represent images to be used for the purpose of advertisements, decorations, and the like. The first image layer 52 and the second image layer 54 may represent the same images or different images. When the printed material 5 is attached on, for example, windows of buildings or vehicles, the first image layer 52 and the second image layer 54 can be visually recognized from the inside and the outside of the buildings or vehicles.

The intermediate layer 53 comprises a lower white background layer 531 positioned above the first image layer 52, a light blocking layer 532 positioned above the lower white background layer 531, and an upper white background layer 533 positioned above the light blocking layer 532. The lower white background layer 531 and the upper white background layer 533 are formed of white ink. In FIG. 3, hatchings in the lower white background layer 531 and the upper white background layer 533 are omitted. The light blocking layer 532 is a layer of almost gray, which is formed of color ink.

When the base member 51 is seen from the lower side in FIG. 3, an image of the first image layer 52 is visually recognized with the lower white background layer 531 as a background, and when the base member 51 is seen from the upper side in FIG. 3, an image of the second image layer 54 is visually recognized with the upper white background layer 533 as a background. In the printed material 5, since the light blocking layer 532 is provided, it is possible to prevent the light entering the base member 51 from going through the intermediate layer 53. When the first image layer 52 is visually recognized, it is thereby possible to prevent the color of the second image layer 54 from appearing in the first image layer 52. Similarly, when the second image layer 54 is visually recognized, it is thereby possible to prevent the color of the first image layer 52 from appearing in the second image layer 54.

Figure 4:
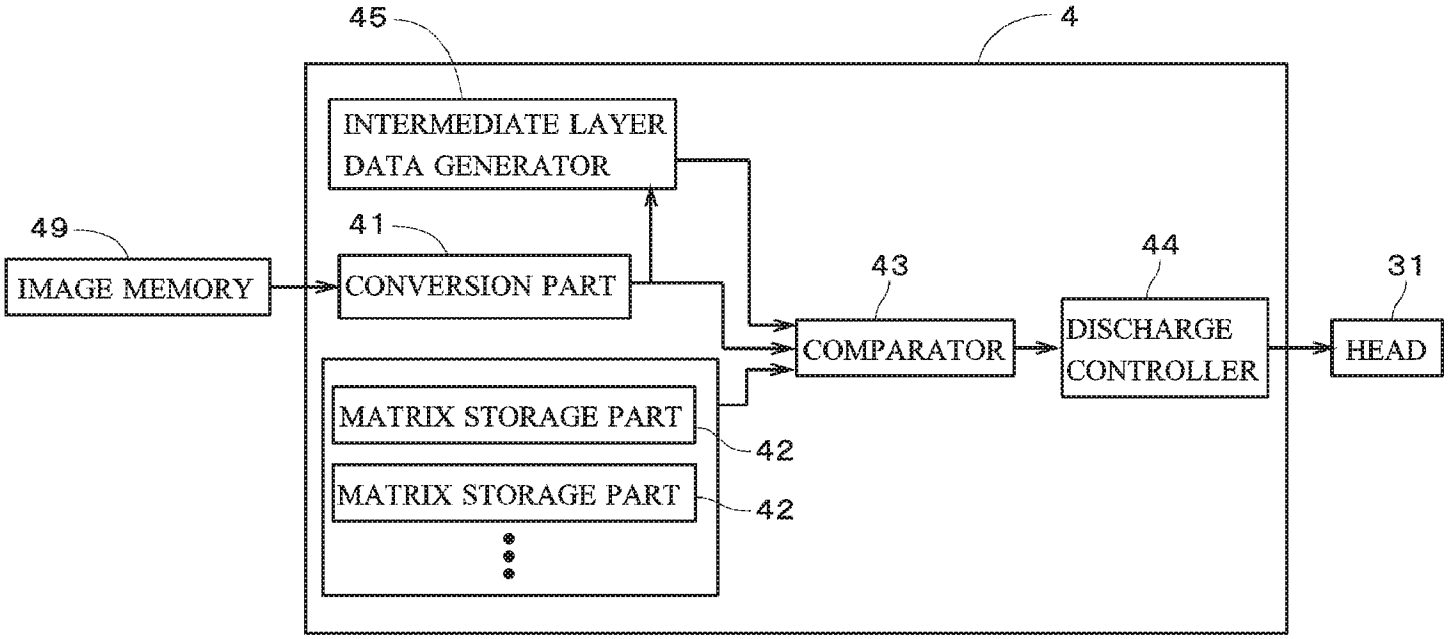
FIG. 4 is a view showing a functional constitution of the printer.

FIG. 4 is a block diagram showing part of a functional constitution of the controller 4. The controller 4 comprises a conversion part 41, a plurality of matrix storage parts 42, a comparator 43, a discharge controller 44 for controlling the discharge of ink, and an intermediate layer data generator 45. The controller 4 also has other functions such as control over the base member moving mechanism 12 and the like. FIG. 4 shows only one head 31. In an image memory 49 of a computer connected to the controller 4, image data representing the first image layer 52 and image data representing the second image layer 54 are stored. The image memory 49 may be provided in the controller 4. These image data are inputted to the conversion part 41 and converted into data of color spaces corresponding to the printer 1 by ICC (International Color Consortium) profile and the like. In the following discussion, the converted image data corresponding to the first image layer 52 is referred to as "first image layer data", and the converted image data corresponding to the second image layer 54 is referred to as "second image layer data". The first image layer data has pixels each having a pixel value of each color, ranging from 0 to 255, representing the gray level and substantially indicates the amount of ink of each color to be applied per unit area (hereinafter, referred to simply as the "application amount of ink") at each position on the base member 51. Similarly, the second image layer data also has pixels each having a pixel value of each color, ranging from 0 to 255, representing the gray level and substantially indicates the application amount of ink of each color at each position on the base member 51.

The intermediate layer data generator 45 generates white background layer data representing the lower white background layer 531 and the upper white background layer 533 and light blocking layer data representing the light blocking layer 532. All the pixel values in the white background layer data are each "255". As long as solid printing where ink is applied to entire the surface of a printing area (image forming area) can be performed, the respective pixel values of the lower white background layer 531 and the upper white background layer 533 may be lower than 255. The light blocking layer data has pixels each having a pixel value of each color, ranging from 0 to 255, representing the gray level. In the following discussion, when it is not necessary to make distinction among these data, all of the first image layer data, the second image layer data, the white background layer data, and the light blocking layer data are referred to as simply "image layer data".

In the plurality of matrix storage parts 42 (also referred to as SPMs (Screen Pattern Memories)), stored are a plurality of threshold matrices corresponding to a plurality of colors, respectively. The comparator 43 compares the image layer data with the corresponding threshold matrix as discussed later.

Figure 5:
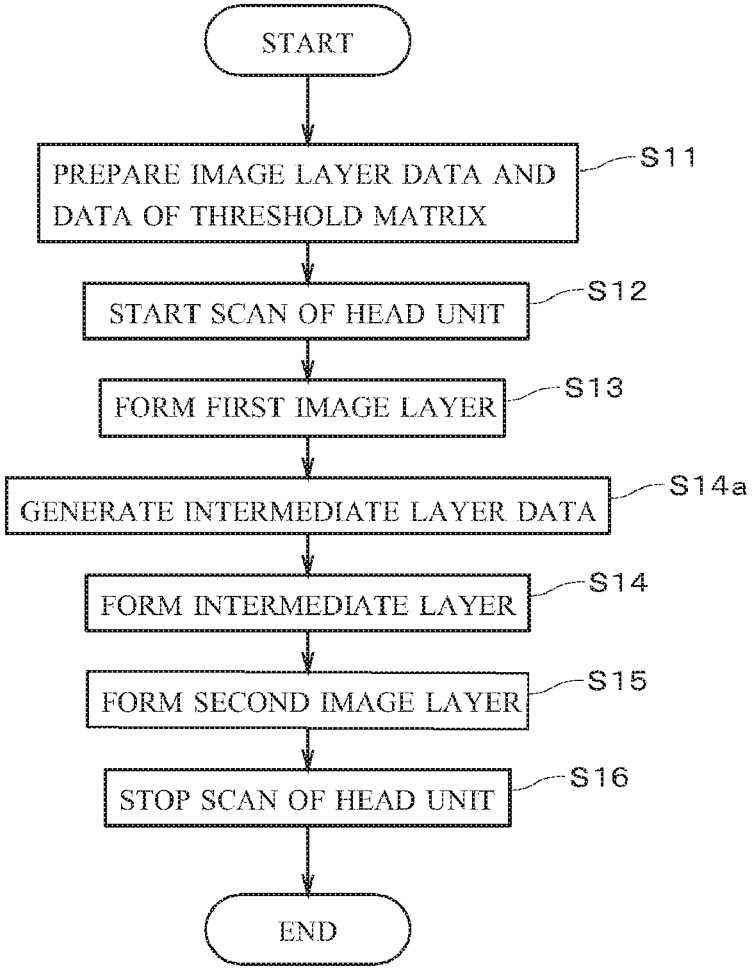
FIG. 5 is a flowchart showing an operation flow for producing the printed material.

Next, with reference to FIG. 5, discussion will be made on an operation of the printer 1 for producing the printed material 5. In a process of producing the printed material 5, first, data of the threshold matrices are outputted from the computer to the controller 4 and stored into the matrix storage parts 42 for preparation. Further, part of the first image layer data and the second image layer data which are printed first are outputted from the image memory 49 of the computer to the conversion part 41 (Step S11). All the first image layer data and the second image layer data may be outputted to the controller 4 in advance.

Figure 6:
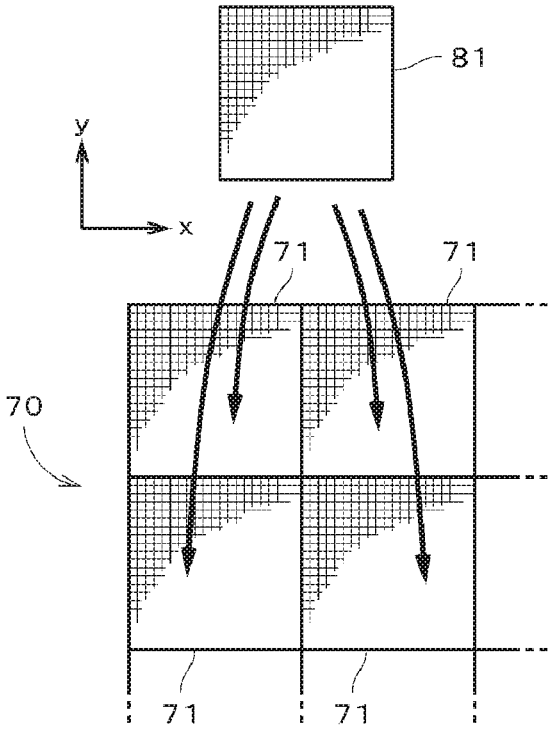
FIG. 6 is a view showing a threshold matrix and image layer data.

FIG. 6 is an abstract view showing a threshold matrix 81 and image layer data 70 (more exactly, an image represented by the image layer data 70). In the threshold matrix 81, a plurality of elements are arranged in a row direction corresponding to the main scan direction (indicated as the x direction in FIG. 6) and in a column direction corresponding to the subscan direction (indicated as the y direction in FIG. 6), and a threshold value is assigned to each element. Like in the threshold matrix 81, in the image layer data 70, a plurality of pixels are arranged in the row direction and the column direction (the x direction and the y direction) (the same applies to halftone image data discussed later). In the present preferred embodiment, prepared are four threshold matrices 81 corresponding to ink of four colors used for forming the first image layer 52, the second image layer 54, and the light blocking layer 532 and one threshold matrix 81 corresponding to the white ink used for forming the lower white background layer 531 and the upper white background layer 533.

After the plurality of threshold matrices 81 are prepared, by comparing the image layer data 70 with the corresponding threshold matrix 81, generated is halftone image data to be used for controlling the heads 31 to 35 to discharge ink.

Herein, discussion will be made on halftoning of the image layer data 70. The following discussion will be made by specifying the image layer data 70 of one color (referred to simply as "image layer data 70" in the description of FIG. 6) and the corresponding threshold matrix 81, and the same operation is performed on the other colors and the other image layer data 70. In the halftoning of the image layer data 70, as shown in FIG. 6, the image layer data 70 is divided into a lot of areas having the same size and these areas are set as repeat areas 71 each serving as a unit of halftoning. Each of the matrix storage parts 42 has a storage area which corresponds to one repeat area 71. A threshold value is set to each address (coordinate) of the storage area, and the threshold matrix 81 which is a two-dimensional array of a plurality of threshold values is thereby stored. Conceptually, by superimposing the threshold matrix 81 on each of the repeat areas 71 of the image layer data 70 and comparing the pixel value of each pixel of the repeat area 71 with the corresponding threshold value in the threshold matrix 81, it is determined whether a dot of ink has to be formed or not at the position of the pixel on the base member 51.

In an actual operation, the pixel value of one pixel in the image layer data 70 is read out on the basis of an address signal from an address generator included in the comparator 43 of FIG. 4. On the other hand, the address generator generates an address signal indicating a position in the repeat area 71 corresponding to the pixel in the image layer data 70, and one threshold value in the threshold matrix 81 is thereby specified and read out from the matrix storage parts 42. The comparator 43 compares the pixel value with the threshold value, and the pixel value of the position (address) of the pixel in the binary halftone image data is thereby determined.

In the preferred embodiment, in the image layer data 70 shown in FIG. 6, for example, a pixel value of "1" indicating that a dot has to be formed is given to a position whose pixel value is larger than the corresponding threshold value in the threshold matrix 81 and a pixel value of "0" indicating that a dot has not to be formed is given to the other pixels. Thus, the comparator 43 serving as a halftone image generator performs halftoning of each color in the image layer data 70, i.e., rasterization for the discharge of ink, by using the threshold matrix 81, to thereby generate the halftone image data.

After the halftone image data of a portion (for example, the first repeat area 71 on the (+y) side in FIG. 6) of the image layer data 70 which is to be printed first is generated, the head unit 3 is positioned at a predetermined recording start position and starts continuously moving in the main scan direction (i.e., the X direction of FIG. 1) and intermittently moving relatively in the subscan direction (i.e., the Y direction of FIG. 1) (Step S12). Further, concurrently with the main scan of the head unit 3, the discharge controller 44 shown in FIG. 4 controls the discharge of ink from the plurality of discharge ports 311 included in the heads 31 to 35 shown in FIG. 2.

In the first main scan of the head unit 3, control is made on the heads 31 to 34 which discharge the color ink in accordance with the halftone image data generated from the first image layer data. With this control, concurrently with the main scan of the head unit 3, the color ink is discharged to a discharge position on the base member 51 from each of the discharge ports 311 of the heads 31 to 34 when the pixel value of the halftone image data corresponding to the discharge position indicates "1" and no color ink is discharged to the discharge position when the pixel value of the halftone image data corresponding thereto indicates "0". Thus, with the control of the discharge controller 44, the color ink is applied to an area (a strip-like area extending in the main scan direction, hereinafter referred to as a "swath") on the recording surface of the base member 51 on which the head unit 3 of FIG. 1 passes, and the first image layer of one swath is formed by one main scan.

In an actual case, each of the heads 31 to 35 shown in FIG. 2 is divided in the subscan direction and the width of one swath is equal to the divided width. The head unit 3 performs the subscan by the divided width. Hereinafter, for simple discussion, it is assumed that the heads 31 to 35 are not divided and the head unit 3 repeats the main scan at the same position, to thereby accumulate (stack) the ink.

Figure 7:
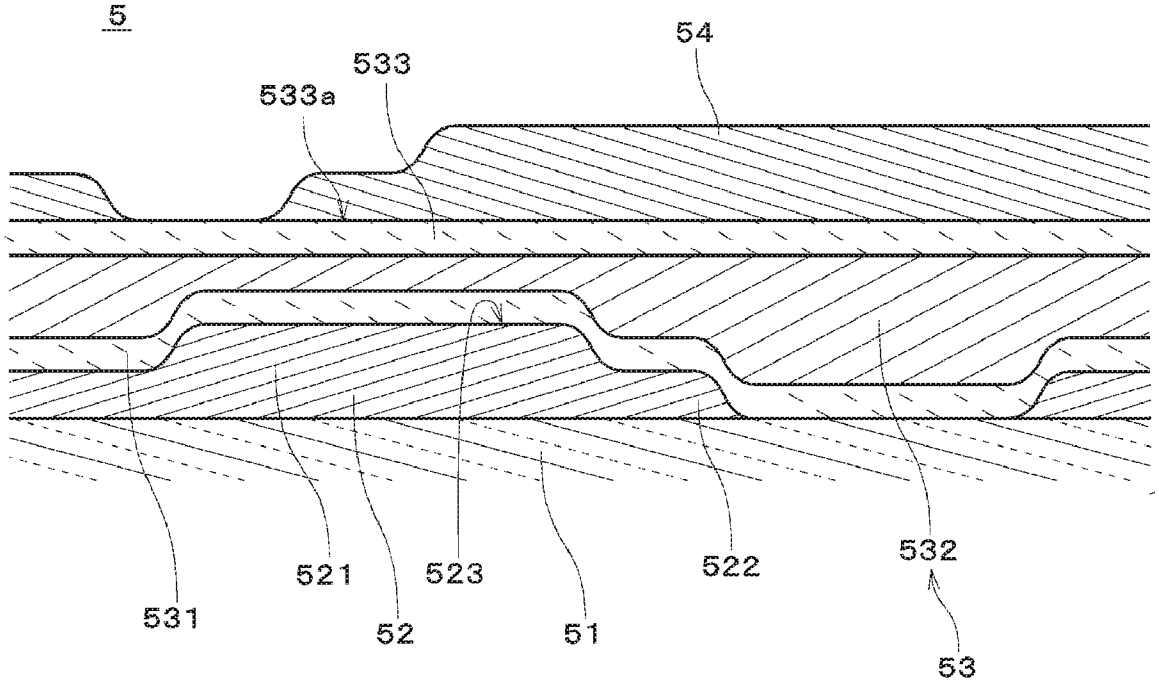
FIG. 7 is a cross section of the printed material.

FIG. 7 is a cross section of the printed material 5. In an area 521 of the first image layer 52, where a large amount of ink is applied, the first image layer 52 is thick. In an area 522 of the first image layer 52, where a small amount of ink is applied, the first image layer 52 is thin. Naturally, in an area where no ink is applied, there is no first image layer 52. Thus, the first image layer 52 has undulation (concavity and convexity) in accordance with the amount of applied ink (application amount of ink). In FIG. 7, respective thicknesses of the image layers are exaggerated.

In the second main scan of the head unit 3, control is made only on the head 35 for discharging the white ink. At that time, the white background layer data is read out from the intermediate layer data generator 45 to the comparator 43 shown in FIG. 4. All the pixel values in the white background layer data are each "255", and all the pixel values in the halftone image data generated from the white background layer data each indicate "1". Thus, the lower white background layer 531 of one swath is formed on the first image layer 52.

In the third main scan of the head unit 3, control is made on the heads 31 to 34 for discharging the color ink. The intermediate layer data generator 45 generates the light blocking layer data in a light blocking layer data generation process discussed later and generates halftone image data in accordance with the light blocking layer data. In the halftone image data, the application amount of ink at each position on the base member 51 is so determined as to cancel the undulation of the first image layer 52. Then, the light blocking layer 532 of one swath is formed by the color ink.

In the fourth main scan of the head unit 3, the white background layer data is read out from the intermediate layer data generator 45 and control is made on the head 35 for discharging the white ink. Like the lower white background layer 531, the upper white background layer 533 of one swath is formed on the light blocking layer 532 by the white ink in accordance with the white background layer data. Through the above operation flow, the intermediate layer 53 of one swath is formed on the first image layer 52 in accordance with the intermediate layer data, by the control of the discharge controller 44.

In the fifth main scan of the head unit 3, the halftone image data is generated in accordance with the second image layer data, and the discharge controller 44 controls the heads 31 to 34 for discharging the color ink in accordance with the halftone image data. With this control, the second image layer 54 of one swath is formed by the color ink on the intermediate layer 53.

In the preferred embodiment, ink discharge control is made on any of the heads 31 to 35 in each of the moving forward and the moving back of the head unit 3 of FIG. 2 in the main scan direction. There may be another case, however, where the head unit 3 is provided with only one light emitting part 38 on the (−X) side of the heads 31 to 35, instead of the two light emitting parts 38, and the ink discharge control is performed only in the main scan of the head unit 3 toward the (+X) direction and the next main scan is performed after the head unit 3 returns to the (−X) side of the base member 51.

After parts of the first image layer 52, the intermediate layer 53, and the second image layer 54 are formed by the five continuous main scans of the head unit 3, the base member 51 shown in FIG. 1 moves to the subscan direction by the width of one swath and the head unit 3 performs subscan relatively to the base member 51. Then, by the next continuous five main scans, other parts of the first image layer 52, the intermediate layer 53, and the second image layer 54 are sequentially formed on a swath adjacent to the previous swath. Thus, by repeating the five main scans and one subscan of the head unit 3 while generating the intermediate layer data (or after the generation of the intermediate layer data), the first image layer 52, the intermediate layer 53, and the second image layer 54 are formed on the entire image forming area of the base member 51 (Steps S13, S14*a*, S14, and S15). This repeat operation is not shown in FIG. 5.

After the entire forming of the first image layer 52, the intermediate layer 53, and the second image layer 54 is completed, the main scan and the subscan of the head unit 3 are stopped (Step S16) and the printed material 5 is completely produced.

Figure 8:
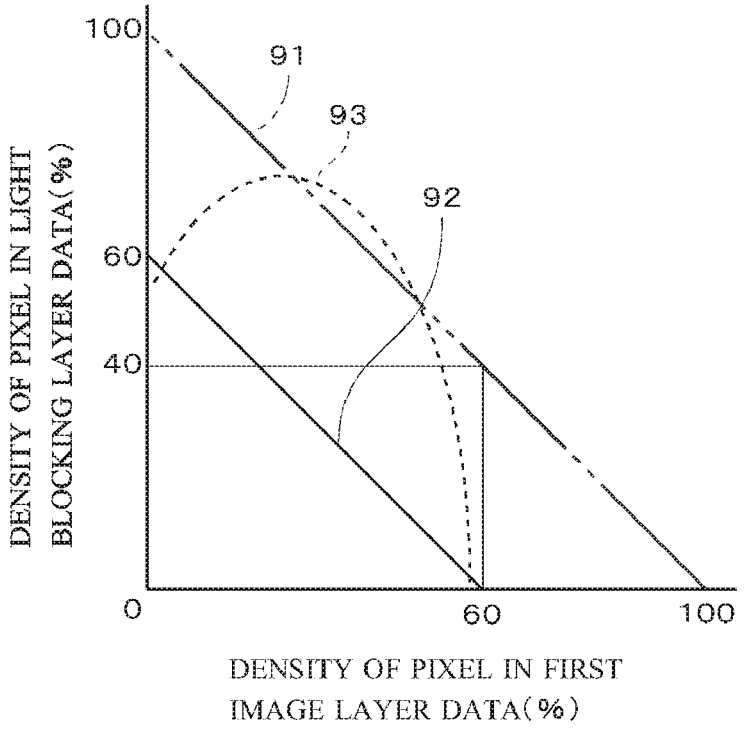
FIG. 8 is a graph showing a relation between first image layer data and light blocking layer data.

Next, discussion will be made on the generation of the light blocking layer data in the intermediate layer data generator 45. Hereinafter, discussion will be made by specifying one color of the CMYK but the same applies to the other colors. FIG. 8 is a graph showing a relation between a pixel value of the first image layer data and a pixel value of the light blocking layer data at the same position. In FIG. 8, the horizontal axis represents the pixel value of the first image layer data and the vertical axis represents the pixel value of the light blocking layer data. In the horizontal axis and the vertical axis, however, the pixel values of 0 to 255 are represented as the densities of pixel, 0% to 100%. A curve 93 represents a distribution of the number of pixels with respect to the density of pixel in the first image layer. In the following discussion, the density is equivalent to the pixel value.

Conceptually, the intermediate layer data generator 45 generates the light blocking layer data by performing an offset on data of a negative image obtained by inverting the gray level of the first image layer. Specifically, first, the density of each pixel in the first image layer data is subtracted from 100% which is the maximum value of the density of each color. When the density of a pixel of the first image layer data is 30%, for example, the density of a corresponding pixel is 70%, as indicated by a straight line 91. Hereinafter, image data having the relation indicated by the straight line 91 with the first image layer data is referred to as "negative image data".

Most of the densities of the pixels in the first image layer 52 are normally found in a range not smaller than 0% and not larger than 60% (i.e., a range equal to or larger than 0% and equal to or smaller than 60%), as indicated by the curve 93, in order to prevent cockling or banding from being caused in an image. Therefore, most of the densities of the pixels in the negative image data are found in a range not smaller than 40% and not larger than 100%. When the negative image data is used as the light blocking layer data, a large amount of ink is used to form the light blocking layer 532.

Then, a value obtained by subtracting 40% which is an offset value from the density of each pixel in the negative image data is used as the density of the corresponding pixel in the light blocking layer data. When a pixel whose density is smaller than 0% is found, however, the density to be obtained is changed to 0%. With this offset value, as indicated by a solid straight line 92 in FIG. 8, the density of each pixel in the light blocking layer data is reduced to a range not smaller than 0% and not larger than 60%.

In an actual operation, a value (hereinafter, referred to as a "set value") obtained by subtracting 40% which is the offset value from 100% which is the maximum value of the density of each color is set in advance, and by subtracting the density of each pixel in the first image layer data from the set value, the light blocking layer data is generated. In other words, the light blocking layer data is generated by subtracting the application amount of ink of each color at each position indicated by the first image layer data from a preset value (set value). The preset value is smaller than the maximum application amount (100%) of ink of each color at each position.

As shown in FIG. 7, a large amount of ink is discharged to an area of the light blocking layer 532 corresponding to the area 522 of the first image layer 52 in which a small amount of ink is applied and a small amount of ink is discharged to an area of the light blocking layer 532 corresponding to the area 521 of the first image layer 52 in which a large amount of ink is applied. With this control, at each position on the base member 51, the sum of the application amount of ink in the first image layer 52 and the application amount of ink in the light blocking layer 532 is constant, and with the light blocking layer 532, the undulation of a surface (hereinafter, referred to as an "upper surface 523") of the first image layer 52 which is in contact with the lower white background layer 531 is cancelled.

As a result, the upper white background layer 533 formed on the light blocking layer 532 is in parallel with the base member 51 and the second image layer 54 is formed on a flat upper surface 533*a* of the upper white background layer 533. When a certain thickness of the light blocking layer 532 needs to be ensured in an area in which the thickness of the first image layer 52 is the largest, the set value may be set larger, for example, so that the density of each pixel in the light blocking layer data can be increased to a range not smaller than 10% and not smaller than 70%.

In the generation of the light blocking layer data, when the range of the density in the first image layer 52 varies depending on the color, a different set value may be set for each color. With this setting, at each position of the base member 51, the sum of the application amount of ink in the first image layer 52 and the application amount of ink in the light blocking layer 532 is constant for each color, and it is thereby possible to prevent the light blocking layer 532 from becoming excessively thick. However, it is preferred that the set value is smaller than 100% which is the maximum value of the density for each color.

Figure 9:
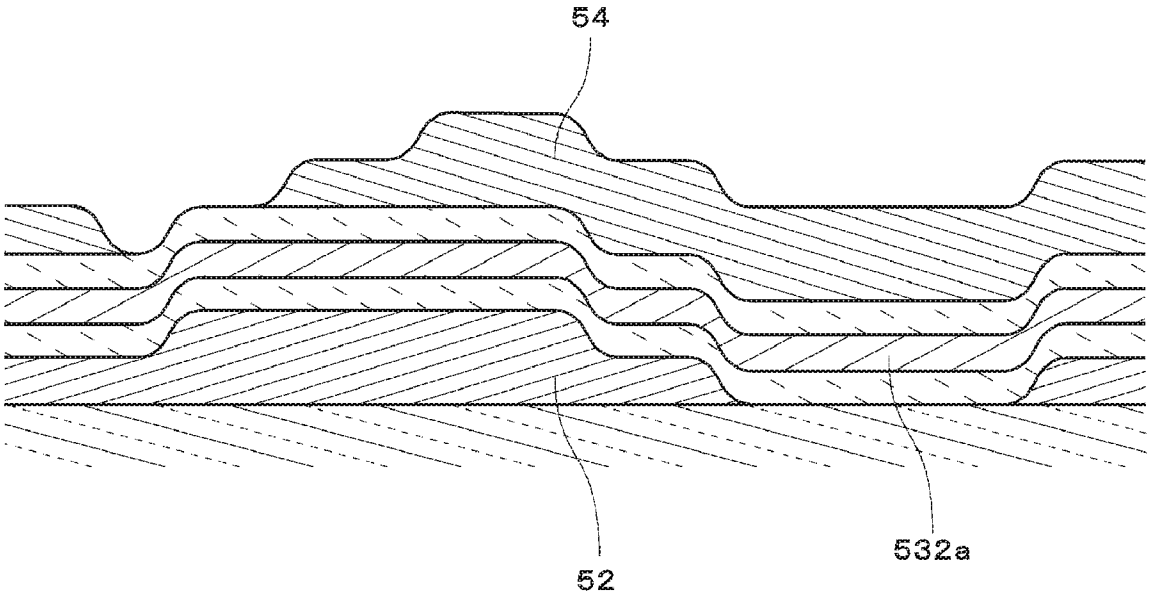
FIG. 9 is a cross section of a printed material in a comparative example.

Though the constitution and the operation of the printer 1 of the first preferred embodiment have been discussed above, in a printed material in which a black tint layer (black solid layer) 532*a* is formed as the light blocking layer as shown in FIG. 9, for example, the undulation of the first image layer 52 appears on the second image layer 54. On the other hand, in the printed material 5 of FIG. 7, since the thickness of the light blocking layer 532 is uneven in conformity with the undulation of the first image layer 52, the upper surface 533*a* of the upper white background layer 533 becomes flat and it is possible to prevent or suppress the undulation of the first image layer 52 from being visually recognized from the side of the second image layer 54. It is not necessary for the upper surface 533*a* of the upper white background layer 533 which is in contact with the second image layer 54, i.e., the surface of the intermediate layer 53 to be exactly flat, and only if a kind of undulation texture, or a relief texture, of the first image layer 52 is hardly recognized from the side of the second image layer 54, slight undulation may be left. The same applies to the following discussion.

Since the light blocking layer 532 is formed by using the ink of a plurality of colors in the printed material 5, it is possible to easily extinguish the undulation of the first image layer 52 even when the undulation cannot be extinguished by application of ink of one color.

As compared with a supposed case where the undulation of the first image layer 52 is cancelled by making the lower white background layer 531 uneven, it is possible to prevent deterioration in the shielding property of color in the lower white background layer 531 and suppress the effect on visual recognition of the first image layer 52 and the second image layer 54.

The first image layer data generated by the conversion part 41 is data immediately before being outputted to the comparator 43, in other words, data immediately before the rasterization for the discharge of ink is performed, and by using the first image layer data, it is possible to easily generate the light blocking layer data indicating the uneven thickness in conformity with the undulation of the first image layer 52.

In the intermediate layer data generator 45, by setting the set value to be smaller than the maximum value of the density of each color, it is possible to decrease the density of each pixel in the light blocking layer data and reduce the consumption of ink. Further, the set value may be changed as appropriate in accordance with the density of the first image layer 52 or the kind of used ink.

The above effect of the first preferred embodiment can be produced also in the following preferred embodiments as long as no inconsistency is caused.

In the first preferred embodiment, the first image layer data may be data which directly indicates the application amount of ink at each position on the base member 51. The same applies to the second image layer data. Each of the first image layer data and the second image layer data may be a set of values, other than the densities, which substantially indicate the application amount of ink.

Figure 10:
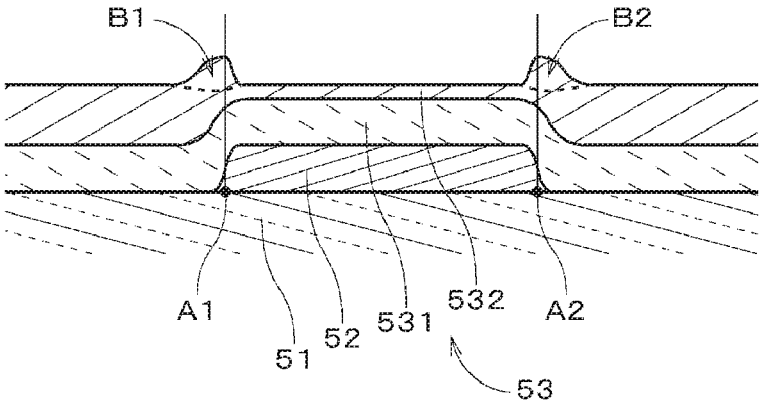
FIG. 10 is a cross section of the printed material being under production.

As shown in FIG. 10, in a portion in which the application amount of ink is largely changed in the formation of the first image layer 52 (two points represented by reference signs A1 and A2 indicate the boundaries at each of which the application amount of ink is largely changed in FIG. 10, and hereinafter these points are referred to as "watched change points"), the color ink slightly spreads from a portion in which a large amount of ink is applied to another portion in which a small amount of ink is applied. Also when the lower white background layer 531 is formed by applying a uniform amount of white ink to all the positions on the base member 51, the white ink slightly spreads near the watched change points A1 and A2 from a portion in which the vertical level from the base member 51 is high to another portion in which the vertical level from the base member 51 is low. Therefore, near the watched change point A1, a level difference part (a center position thereof in the height direction) in the lower white background layer 531 is positioned outside a level difference part in the first image layer 52 (in a direction from the portion in which the vertical level is high toward the portion in which the vertical level is low), and also near the watched change point A2, a level difference part in the lower white background layer 531 is positioned outside a level difference part in the first image layer 52. In other words, the width (or the area) of the portion in the lower white background layer 531 which is located between points corresponding to the watched change points A1 and A2 is larger than the width of the portion in the first image layer 52 which is located between points corresponding to the watched change points A1 and A2.

Then, in the same manner as in the above-discussed exemplary process, the light blocking layer data is generated and the light blocking layer 532 is formed on the lower white background layer 531 in accordance with the light blocking layer data. At that time, since the light blocking layer data is generated by subtracting the application amount of ink of each color at each position indicated by the first image layer data from a preset value, in the area outside the watched change points A1 and A2, in other words, in the portion in which a small amount of ink is applied for the formation of the first image layer 52, the application amount of ink for the formation of the light blocking layer 532 is larger than that in the area inside (between) the watched change points A1 and A2. As a result, in the outer vicinities of the watched change points A1 and A2, bumps B1 and B2 which swell as compared with the other portions are formed in the light blocking layer 532. In such a case, there is a possibility that a kind of undulation texture of the bumps B1 and B2, or a relief texture, can be recognized from the side of the second image layer 54 after the upper white background layer 533 and the second image layer 54 are formed on the light blocking layer 532. Actually, at the watched change points, as the level difference (density difference) in the first image layer 52 becomes larger, the bumps B1 and B2 become larger since the position of the level difference part in the lower white background layer 531 spreads outside. Then, discussion will be made below on a technique for reducing the swelling of the light blocking layer 532 in the portion in which the level difference of the first image layer 52 is large.

Figure 11:
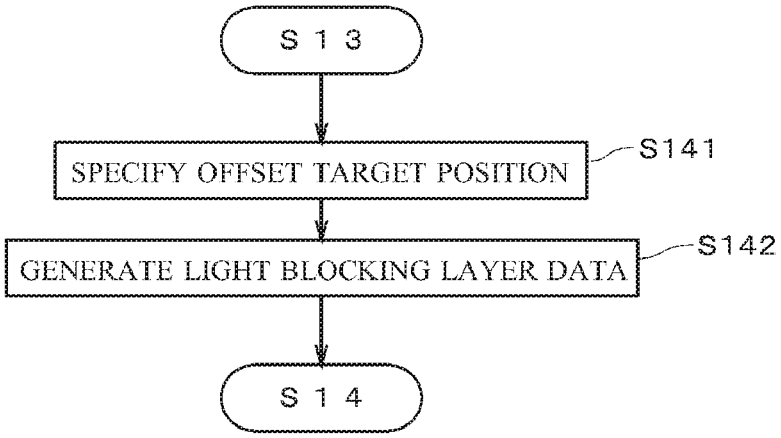
FIG. 11 is a flowchart showing part of the operation flow for producing the printed material.

FIG. 11 is a flowchart showing part of the operation flow for producing the printed material. This flowchart shows operations performed in Step S14*a* of FIG. 5. The intermediate layer data generator 45 specifies a position where the application amount of ink is smaller than that at an adjacent position by a predetermined value or more in the first image layer data as an offset target position. Specifically, with respect to each color of each pixel (each position) in an image represented by the first image layer data, values are obtained by subtracting the density of the pixel from respective densities of eight neighbor pixels of the above pixel. When the maximum value of these obtained values is, for example, the density of 30% or more, this pixel is specified as an offset target position for the color (Step S141). Subsequently, subtraction image data is generated by subtracting the application amount of ink of each color at each position, which is indicated by the first image layer data, from a preset value. The manner of generating the subtraction image data is the same as that of generating the light blocking layer data in the above-discussed exemplary process. Then, in the subtraction image data, the density of the color of the pixel corresponding to the offset target position of each color is, for example, halved (reduced to 50% thereof), and the light blocking layer data to be used for the formation of the light blocking layer 532 is thereby generated (Step S142).

In the printer 1, like in the above-discussed exemplary process, the lower white background layer 531, the light blocking layer 532, and the upper white background layer 533 are formed as the intermediate layer 53 on the first image layer 52 in this order, and then the second image layer 54 is formed on the intermediate layer 53. At that time, the white background layer data (background layer data) indicating that a constant amount of ink is applied to each position on the base member 51 is used for the formation of the lower white background layer 531 which is a background layer of the first image layer 52 and the upper white background layer 533 which is a background layer of the second image layer 54. Further, the light blocking layer data generated in the above-discussed process of Step S142 is used for the formation of the light blocking layer 532. At that time, since the offset target position is a position adjacent to the watched change point in its outer side and the value for each color at the offset target position in the light blocking layer data is smaller than the value in the subtraction image data, the swelling of the light blocking layer 532 in the portion of large level difference in the first image layer 52 can be reduced (in other words, it is possible to prevent or suppress the bumps B1 and B2 from appearing) as represented by dashed lines in FIG. 10.

In a case of adopting this technique for reducing the swelling of the light blocking layer 532, when the change of the color in the second image layer 54 is within tolerance, the upper white background layer 533 may be omitted. In other words, when the lower white background layer 531 and the light blocking layer 532 are formed as at least part of the intermediate layer 53 (i.e., as layers included in the intermediate layer 53), by adopting this technique, it is possible to reduce the swelling of the light blocking layer 52 in the portion of large level difference in the first image layer 52. In the specification of the offset target position, each pixel in the image represented by the first image layer data may be compared with only four pixels near the pixel (four neighbor pixels), or may be compared with only the upper and lower pixels or only the left and right pixels of the pixel. Further, the light blocking layer data may be generated by decreasing a value(s) of a position(s) (pixel) adjacent to the offset target position in its outer side in the subtraction image data derived from the first image layer data. In the above-discussed subtraction image data, the range (the number of pixels) in which the value is decreased and the degree to which the value is decreased are changed as appropriate depending on the kind of ink or the kind of printed material. This technique may be used in the second and fourth preferred embodiments discussed later.

Figure 12:
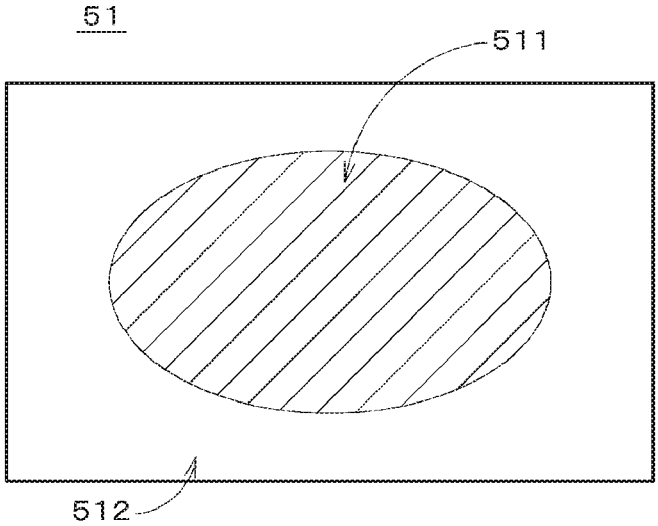
FIG. 12 is a plan view of a base member.

Next, discussion will be made on another exemplary process in the printer 1. In this exemplary process, as shown in FIG. 12, the first image layer 52, the intermediate layer 53, and the second image layer 54 are formed only in a certain area 511 (hatched in FIG. 12) on the base member 51 and none of the first image layer 52, the intermediate layer 53, and the second image layer 54 is formed in the remaining area 512 on the base member 51.

In this exemplary process, the image data to be inputted to the conversion part 41 is produced so that the density (of each color) of each pixel in an area (hereinafter, referred to as an "image layer area") of the image presented by the first image layer data generated by the conversion part 41, corresponding to the area 511 on the base member 51, is in a range not smaller than 0% and not larger than 100% and the density of each pixel in another area (hereinafter, referred to as a "transparent area") corresponding to the area 512 on the base member 51 is 0%. Further, the image data to be inputted to the conversion part 41 is produced so that the density of each pixel in the transparent area of the image represented by the second image layer data generated by the conversion part 41 is 0%. In the image represented by the second image layer data, the image layer area may include pixels whose density is 0%.

Figure 13:
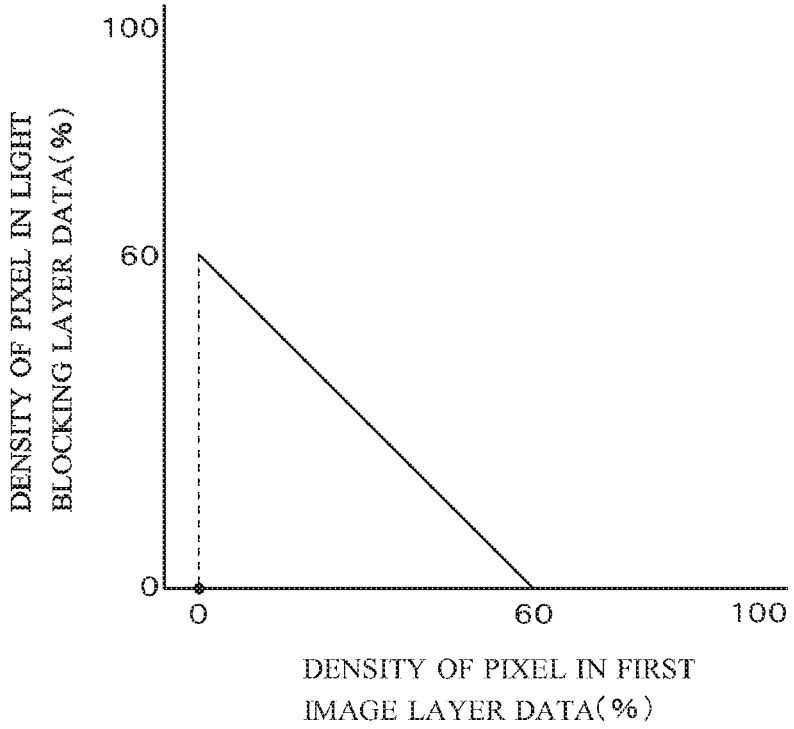
FIG. 13 is a graph showing a relation between the first image layer data and the light blocking layer data.

FIG. 13 is a graph showing a relation between the density of the first image layer data at each position and the density of the light blocking layer data at the same position as that position, which is a graph corresponding to that of FIG. 8. In the generation of the light blocking layer data by the intermediate layer data generator 45, the relation of FIG. 13 is used, instead of the relation indicated by the straight line 92 of FIG. 8. The relation shown in FIG. 13 is different from the relation indicated by the straight line 92 of FIG. 8 only in that when the density of a pixel in the first image layer data is 0%, the density of the corresponding pixel in the light blocking layer data is outputted as 0%. When the density of a pixel in the first image layer data has any other value, the density of the corresponding pixel in the light blocking layer data to be outputted is the same as indicated by the straight line 92 of FIG. 8. As discussed earlier, since the density of each pixel in the transparent area of the first image layer data is 0%, the density of each pixel in the transparent area of the light blocking layer data is 0%. Thus, by using the relation shown in FIG. 13, a desensitization process in which no light blocking layer is formed at the position where the density in the first image layer data is 0% is added to the process using the relation indicated by the straight line 92 of FIG. 8. The density of each pixel in the image layer area of the light blocking layer data is in a range not smaller than 0% and not larger than 60% in accordance with the density of the corresponding pixel in the first image layer data.

Figure 14:
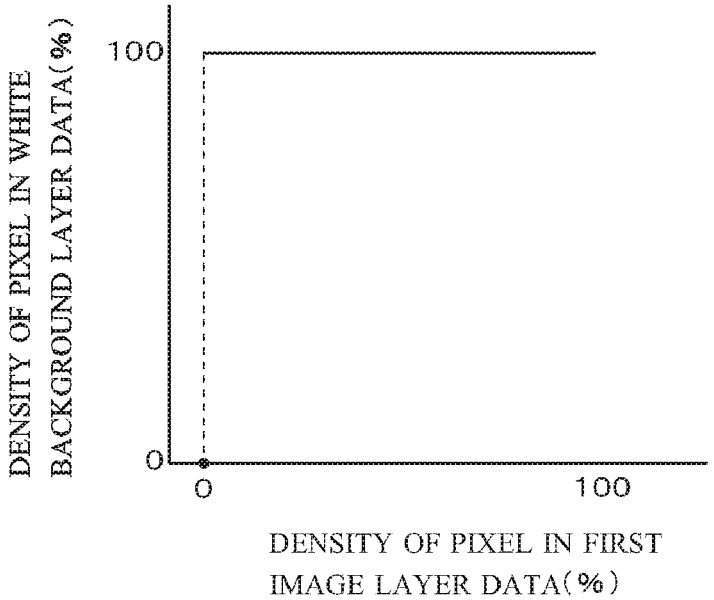
FIG. 14 is a graph showing a relation between the first image layer data and white background layer data.

FIG. 14 is a graph showing a relation between the density of the first image layer data at each position and the density of the white background layer data at the same position as that position, which is a graph corresponding to that of FIG. 8. In the intermediate layer data generator 45, the white background layer data is generated by using the relation of FIG. 14. In FIG. 14, when the density of a pixel in the first image layer data is 0%, the density of the corresponding pixel in the white background layer data is outputted as 0%, and when the density of a pixel in the first image layer data has any other value, the density of the corresponding pixel in the white background layer data is outputted as 100%. Therefore, the density of each pixel in the transparent area of the white background layer data is 0% and the density of each pixel in the image layer area of the white background layer data is 100%. Further, the white background layer data in which the density of each pixel in the transparent area is 0% and the density of each pixel in the image layer area is 100% may be generated by preparing image data corresponding to the white background layer data and inputting the image data to the conversion part 41.

The first image layer data, the intermediate layer data (i.e., the white background layer data and the light blocking layer data), and the second image layer data are data immediately before the rasterization for the discharge of ink is performed, and each of these data is outputted to the comparator 43, to thereby generate the halftone image data corresponding to the respective image layer data. As discussed earlier, since the image represented by the first image layer data is constituted (consists) of the image layer area representing the application of ink at each position and the transparent area representing non-application of ink at each position, the color ink is applied to the area 511 on the base member 51 shown in FIG. 12 in accordance with the first image layer data and no color ink is applied to the area 512 in the formation of the first image layer 52.

Figure 15:
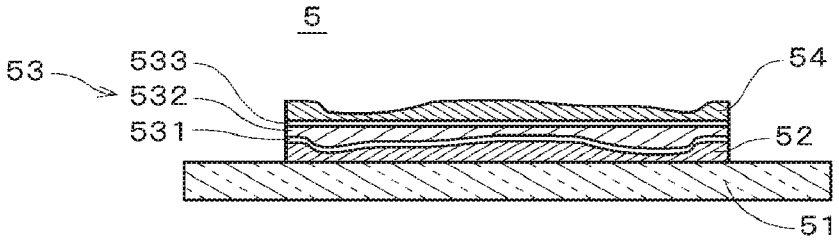
FIG. 15 is a view showing another example of a printed material.

In the formation of the lower white background layer 531, the white ink is applied to the entire first image layer 52 (i.e., the entire area 511) in accordance with the white background layer data and no white ink is applied to the area 512. In the formation of the light blocking layer 532, the color ink is applied on the lower white background layer 531 in accordance with the light blocking layer data and no color ink is applied to the area 512. In the formation of the upper white background layer 533, like in the formation of the lower white background layer 531, the white ink is applied to the entire light blocking layer 532 in accordance with the white background layer data and no white ink is applied to the area 512. In the formation of the second image layer 54, the color ink is applied on the upper white background layer 533 in accordance with the second image layer data and no color ink is applied to the area 512. The printed material 5 shown in FIG. 15 is thereby produced. In FIG. 15, respective thicknesses of the first image layer 52, the intermediate layer 53, and the second image layer 54 are exaggerated.

Herein, in the case where the light blocking layer data is generated by using the relation indicated by the straight line 92 of FIG. 8, when the density of a pixel in the first image layer data is 0%, the density of the corresponding pixel in the light blocking layer data is outputted as 60%. Therefore, even when the image represented by the first image layer data is constituted of the image layer area representing the application of ink at all the positions and the transparent area representing non-application of ink at all the positions, the light blocking layer 532 is formed in the area 512 on the base member 51 (the same applies to the lower white background layer 531 and the upper white background layer 533).

On the other hand, in this exemplary process, by using the relation of FIG. 13 in which when the density of a pixel in the first image layer data is 0%, the density of the corresponding pixel in the light blocking layer data is outputted as 0%, the light blocking layer data representing non-application of ink at each position in the area corresponding to the area 512 on the base member 51 (the same applies to the white background layer data). It is thereby possible to easily provide the transparent area in the printed material 5. The area 511 to which ink is applied is not limited to such a shape as shown in FIG. 12 but may have any one of various shapes. By the technique of this exemplary process, it is possible to form the first image layer 52 and the second image layer 54 which are trimmed in various shapes, on the base member 51. In the first image layer data, since the density of each pixel in the image layer area corresponding to the area 511 is larger than 0%, there is no portion which is represented with only white of the lower white background layer 531 serving as a background when the first image layer 52 is observed. However the portion in which the density in the first image layer data is low (for example, the density of several %) is recognized to be almost white by an observer and therefore there is no problem in the quality of the printed material to be produced.

Figure 16:
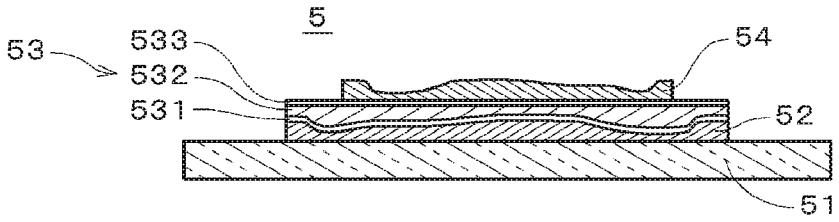
FIG. 16 is a view showing still another example of a printed material.
Figure 17:
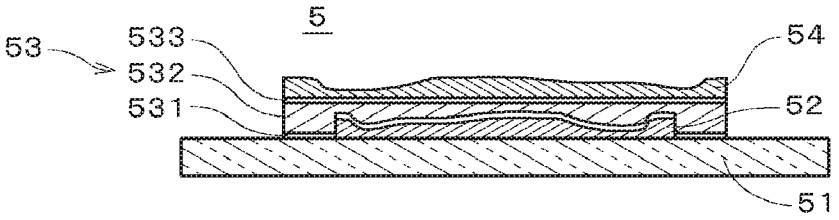
FIG. 17 is a view showing yet another example of a printed material.

While the first image layer 52, the intermediate layer 53, and the second image layer 54 are formed in the same area on the base member 51 in the printed material 5 of FIG. 15, there may be a case, as shown in FIG. 16, where only the first image layer 52 and the intermediate layer 53 are formed in the same area on the base member 51 and the second image layer 54 is formed in an area which is included in the above area and smaller than the above area. Further, there may be another case, as shown in FIG. 17, where only the intermediate layer 53 and the second image layer 54 are formed in the same area on the base member 51 and the first image layer 52 is formed in an area which is included in the above area and smaller than the above area. In this case, an image represented by the second image layer data consists of the image layer area(s) representing the application of ink at each position and the transparent area(s) representing non-application of ink at each position. Like in the above-discussed exemplary process, after the light blocking layer data and the white background layer data are temporarily generated by using the first image layer data, the density in the image represented by the temporarily generated light blocking layer data, which is 0% at the position which overlaps the image layer area of the image represented by the second image layer data, is changed to 60% and the density in the image represented by the temporarily generated white background layer data, which is 0% at the position which overlaps the image layer area of the image represented by the second image layer data, is changed to 100%. The intermediate layer 53 shown in FIG. 17 (consisting of the lower white background layer 531, the light blocking layer 532, and the upper white background layer 533) is thereby formed.

Thus, the image represented by one image layer data out of the first image layer data and the second image layer data consists of the image layer area(s) representing the application of ink at each position and the transparent area(s) representing non-application of ink at each position, and the intermediate layer data is generated by using at least the one image layer data. The image represented by the intermediate layer data shows non-application of ink at each position in an area overlapping the transparent area of the image represented by the one image layer data. Since the image represented by the other image layer data also shows non-application of ink at each position in an area overlapping the transparent area of the image represented by the one image layer data, it is possible to easily provide the transparent area in the printed material 5.

Figure 18:
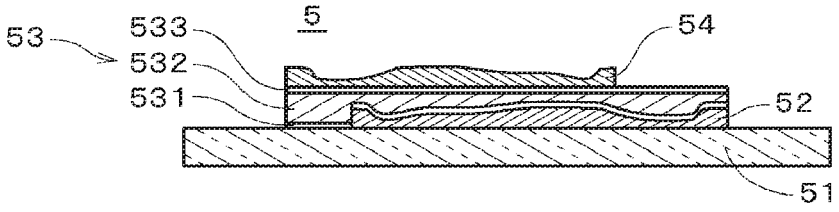
FIG. 18 is a view showing still yet another example of a printed material.

Further, as shown in FIG. 18, the intermediate layer 53 may be formed in an area(s) overlapping the image layer area(s) of at least one of the first image layer 52 and the second image layer 54. In this case, the image represented by the first image layer data consists of the image layer area(s) representing the application of ink at each position and the transparent area(s) representing non-application of ink at each position, and the image represented by the second image layer data consists of the image layer area(s) representing the application of ink at each position and the transparent area(s) representing non-application of ink at each position. Like in the above-discussed exemplary process, after the light blocking layer data and the white background layer data are temporarily generated by using the first image layer data, the density in the image represented by the temporarily generated light blocking layer data, which is 0% at the position which overlaps the image layer area of the image represented by the second image layer data, is changed to 60% and the density in the image represented by the temporarily generated white background layer data, which is 0% at the position which overlaps the image layer area of the image represented by the second image layer data, is changed to 100%. Thus, the intermediate layer data is generated by using the first image layer data and the second image layer data, and the image represented by the intermediate layer data shows non-application of ink at each position in an area overlapping both the transparent area of the image represented by the first image layer data and the transparent area of the image represented by the second image layer data. As a result, it is possible to easily provide the transparent area in the printed material 5. The above-discussed technique for providing the transparent area in the printed material 5 may be used in the second to fourth preferred embodiments discussed later.

Next, discussion will be made on generation of the light blocking layer data in the printer in accordance with the second preferred embodiment. The constitution and the operation of the printer are the same as those in the first preferred embodiment, and the structure of the printed material produced by the printer is almost the same as that of the first preferred embodiment. Hereinafter, the constituent elements identical to those of the first preferred embodiment are represented by the same reference signs.

In the intermediate layer data generator 45 shown in FIG. 4, the density of each color of each pixel in the first image layer data is subtracted from the set value for the color, and the sum total of the subtraction values of all the colors is divided by four which is the number of colors of ink, to obtain the density of each color of each pixel in the light blocking layer data. This process is equivalent to a process in which the sum of the densities of the four colors of each pixel in the first image layer data is subtracted from the sum of the set values for the four colors and the subtraction value is divided by four, to obtain the density of each color at each pixel in the light blocking layer data. With this process, the light blocking layer 532 of uniform gray (mixed color) is formed in the entire image forming area on the base member 51.

In the case where the color of the light blocking layer 532 is uniform gray in FIG. 7, even when the lower white background layer 531 and the upper white background layer 533 are thin, it is possible to surely prevent the color irregularity (mura) from being caused by the appearance of the color of the light blocking layer 532 in the first image layer 52 and the second image layer 54. The densities of all the colors do not need to be exactly the same and may be somewhat changed in accordance with the characteristics of the ink of the colors.

There may be another case where after the density of the pixel at each position in the first image layer data is subtracted from the set value for each color, the subtraction value is multiplied by a predetermined positive correction value which is determined for each color. It is thereby possible to make the sum total of the subtraction values in precise proportion to the thickness of the light blocking layer 532 even when the proportion of the density to the thickness of the layer of ink is different depending on the color.

Also in the second preferred embodiment, since the thickness of the light blocking layer 532 is uneven in conformity with the undulation of the first image layer 52, the upper surface 533*a* of the upper white background layer 533 which is in contact with the second image layer 54 becomes flat and it is possible to prevent or suppress the undulation of the first image layer 52 from being visually recognized from the side of the second image layer 54.

In the intermediate layer data generator 45, since the sum of the set values is smaller than the sum (400%) of the maximum values of the densities of all the colors, it is possible to decrease the density of each pixel in the light blocking layer data and reduce the consumption of ink.

Also in the second preferred embodiment, since the first image layer data is data which substantially indicate the application amount of ink, the light blocking layer data can be generated by subtracting the total application amount of ink at each position on the base member 51, which is indicated by the first image layer data, from a preset value which is a sum of the set values. The sum of the set values is smaller than the maximum total application amount of ink of all the colors discharged at each position on the base member 51.

It is not always necessary for the entire light blocking layer 532 to be a uniform gray image. By forming the light blocking layer 532 as a uniform mixed color image at least in the area where no first image layer 52 is present on the base member 51, uniform light blocking is performed in the area and this prevents the color of the light blocking layer 532 from appearing in the second image layer 54.

In a case of adopting the technique for reducing the swelling of the light blocking layer 532 which is discussed with reference to FIG. 10, in the second preferred embodiment, the position where the total application amount of ink is smaller than that of the adjacent position by a predetermined value or more in the first image layer data is specified as the offset target position. Subsequently, the subtraction image data is generated by subtracting the total application amount of ink at each position on the base member 51, which is indicated by the first image layer data, from a preset value which is the sum of the set values. Then, in the subtraction image data, the density of the pixel corresponding to the offset target position is, for example, halved (reduced to 50% thereof), and the reduced value is divided by four, to obtain the density of each color of the corresponding pixel in the light blocking layer data. It is thereby possible to reduce the swelling (protrusion) of the light blocking layer 532 in the portion of large level difference in the first image layer 52.

Next, discussion will be made on a preferable example of a process in a case where the image forming part 11 in the printer of the second preferred embodiment can also discharge ink of light cyan and light magenta as well as C, M, K, and Y.

In this exemplary process, each pixel in the first image layer data has the respective densities of the six colors, i.e., C, M, K, Y, light cyan, and light magenta, and the first image layer 52 is formed by using ink of the six colors. On the other hand, each pixel in the light blocking layer data has the respective densities of the four colors, i.e., C, M, K, and Y. Specifically, the light blocking layer data is generated by subtracting the sum of the densities of the six colors of each pixel in the first image layer data from the sum of the set values for the six colors and dividing the subtraction value by four, to obtain the respective densities of C, M, K, and Y of the pixel. Then, without using light cyan or light magenta, the light blocking layer 532 is formed by using ink of the four colors, C, M, K, and Y, in accordance with the light blocking layer data. Further, each pixel in the second image layer data has the respective densities of the six colors, i.e., C, M, K, Y, light cyan, and light magenta, and the second image layer 54 is formed by using ink of the six colors. The lower white background layer 531 and the upper white background layer 533 are formed by using the white ink like in the first preferred embodiment.

The density of ink of light cyan and light magenta (hereinafter, referred to generally as "light ink") is generally one third or less (one fourth or more) of the density of ink of cyan and magenta (hereinafter, referred to generally as "normal ink") which are similar colors, and when the light blocking layer 532 contains the light ink, the light blocking property of the light blocking layer 532 decreases.

On the other hand, in this exemplary process, the first image layer 52 is formed by using the normal ink and the light ink each color of which is similar to any one color of the normal ink and has a density lower than that of the corresponding color of normal ink, and the light blocking layer 532 is formed by using only the normal ink, without using any light ink. Therefore, the light blocking layer 532 contains the normal ink but does not contain any light ink. As a result, it is possible to increase the light blocking property of the light blocking layer 532 in the printed material.

This technique for increasing the light blocking property of the light blocking layer may be adopted in a printer, for example, in which the image forming part 11 is capable of discharging only droplets of light cyan and droplets of cyan. In other words, this technique can be adopted in the case where the image forming part 11 is capable of discharging at least droplets of normal ink of one color and droplets of light ink which has a color similar to the one color of the normal ink and has a density lower than that of the normal ink. In this case, normally, the first image layer 52 is formed by using at least the normal ink and the light ink. Further, light ink (e.g., light yellow, light black, and the like) other than light cyan or light magenta may be used. This technique may be used in the fourth preferred embodiment discussed later.

Figure 19:
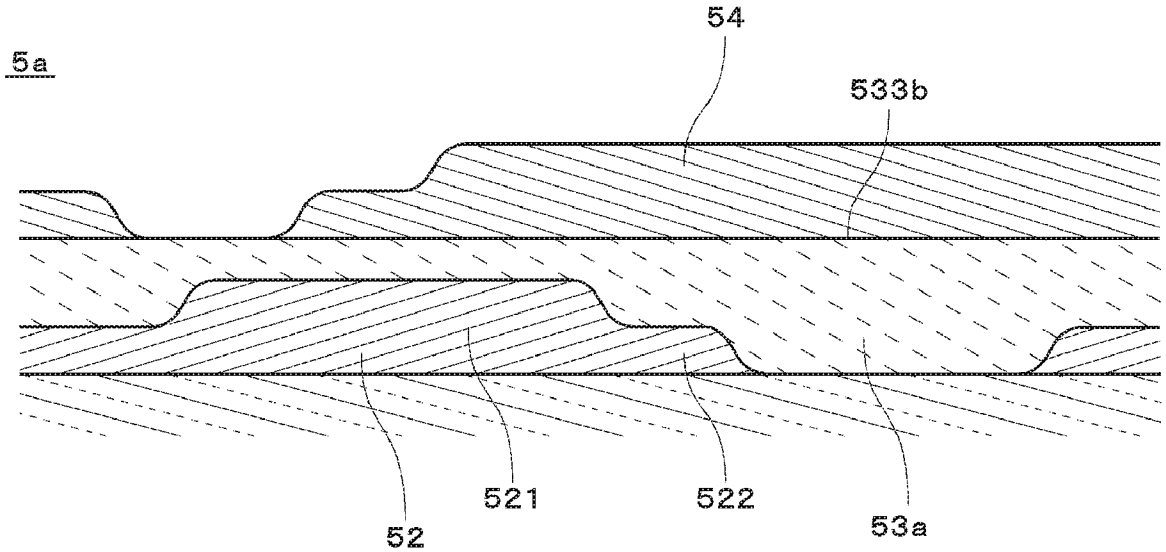
FIG. 19 is a cross section of a printed material in accordance with a third preferred embodiment.

FIG. 19 is a view showing a printed material 5*a* in accordance with the third preferred embodiment. In the printed material 5*a*, an intermediate layer 53*a* is formed by using only the white ink. If the light blocking property of the white ink is high, the intermediate layer 53*a* can sufficiently blocks light only with the white ink. The other constituent elements are identical to those in the printed material 5 of the first preferred embodiment. The constitution of the printer used for printing of the printed material 5*a* is the same as that of the printer 1 of the first preferred embodiment. Hereinafter, the constituent elements identical to those of the first preferred embodiment are represented by the same reference signs.

In a process of producing the printed material 5*a* by using the printer 1, first, the image layer data and the threshold matrix are prepared (Step S11 of FIG. 5), and the controller 4 generates the halftone image data. Next, the head unit 3 is positioned at a predetermined recording start position and starts continuously moving in the main scan direction and intermittently moving relatively in the subscan direction (Step S12). Further, concurrently with the main scan of the head unit 3, the discharge of ink is controlled.

In the first main scan of the head unit 3, in accordance with the halftone image data generated from the first image layer data, the first image layer 52 of one swath is formed as shown in FIG. 19.

Next, a plurality of main scans are performed with the control only on the head 35 for discharging the white ink. At that time, like in the first preferred embodiment, the intermediate layer data generator 45 obtains the intermediate layer data by subtracting the densities of all the colors of each pixel in the first image layer data from the set value which is set in advance.

Then, the intermediate layer 53*a* is formed in accordance with the halftone image data generated form the intermediate layer data. In the formation of the intermediate layer 53*a* with a plurality of main scans, a large amount of ink is discharged to an area corresponding to the area 522 of the first image layer 52 where a small amount of ink is applied and a small amount of ink is discharged to an area corresponding to the area 521 of the first image layer 52 where a large amount of ink is applied. As a result, the undulation of the first image layer 52 is cancelled and an upper surface 533*b* of the intermediate layer 53*a* becomes flat.

After the intermediate layer 53*a* is formed, the second image layer 54 of one swath is formed on the upper surface 533*b* by using the color ink in accordance with the halftone image data generated from the second image layer data.

Then, like in the first preferred embodiment, a plurality of main scans and one subscan are repeated while the intermediate layer data is generated, and thus the first image layer 52, the intermediate layer 53*a*, and the second image layer 54 are stacked on the entire image forming area of the base member 51 (Steps S13 to S15, and S14*a*). After that, the main scan and the subscan of the head unit 3 are stopped (Step S16).

Also in the third preferred embodiment, since the thickness of the intermediate layer 53*a* is uneven in conformity with the undulation of the first image layer 52, it is possible to prevent or suppress the undulation of the first image layer 52 from being visually recognized from the side of the second image layer 54. In the printer 1, when the first image layer 52 has a smaller amount of undulation and a large amount of white ink can be discharged by one main scan, it is possible to reduce the number of main scans of the head unit 3 in the formation of the intermediate layer as compared with the case of the printed material 5 in the first preferred embodiment. As a result, it is possible to increase the productivity of the printed material 5*a*.

Figure 20:
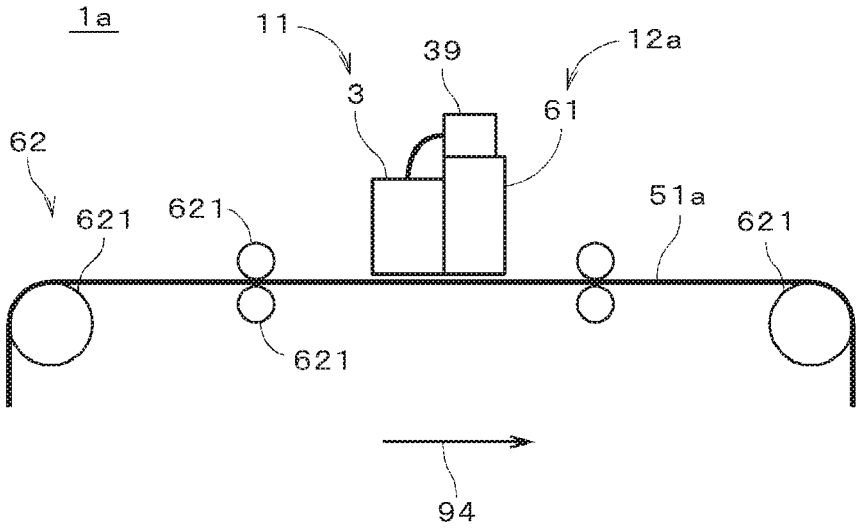
FIG. 20 is a view showing a printer in accordance with a fourth preferred embodiment.

FIG. 20 is a view showing a printer 1*a* in accordance with the fourth preferred embodiment. The printer 1*a* comprises the head unit 3 for performing printing on a web-like transparent base member 51*a*, the light source 39, a head moving mechanism 61 for moving the head unit 3, and a base member feeding mechanism 62 for moving the base member 51*a*. Like in the configuration of FIG. 1, the light source 39 is connected to the head unit 3, and the head unit 3 and the light source 39 constitute the image forming part 11 for forming an image on the base member 51*a*.

The head moving mechanism 61 moves the head unit 3 in the main scan direction perpendicular to a longitudinal direction of the base member 51*a* and in parallel with the base member 51*a*. The base member feeding mechanism 62 comprises a plurality of rollers 621 and a driving source for moving the base member 51*a* in the longitudinal direction. The base member 51*a* is held in a roll in the base member supplying part positioned in the upstream, and the printed base member 51*a* is taken up in a roll in the downstream.

In a process of producing a printed material by using the printer 1*a*, like in the first preferred embodiment, first, the image layer data and the data of the threshold matrix are prepared (Step S11). Next, the head moving mechanism 61 starts continuously moving the head unit 3 in the main scan direction (Step S12). Concurrently with the main scan of the head unit 3, the discharge of ink from the head unit 3 is controlled, and the first image layer, the intermediate layer, and the second image layer all of one swath are formed on the base member 51*a*.

Next, the base member feeding mechanism 62 moves the base member 51*a* by the swath width in a direction indicated by an arrow 94. Then, with the head moving mechanism 61, the head unit 3 moves in the main scan direction while discharging the ink, and the first image layer, the intermediate layer, and the second image layer all of the next swath are thereby formed on the base member 51*a*. Thus, the head moving mechanism 61 and the base member feeding mechanism 62 constitute a base member moving mechanism 12*a* for moving the base member 51*a* relatively to the head unit 3. In the printer 1*a*, by repeating the above operations, the first image layer, the intermediate layer, and the second image layer are formed on the entire image forming area of the base member 51*a* (Steps S13 to S16, and S14*a*).

Also in the fourth preferred embodiment where the base member 51*a* cannot be physically reversed, by printing two images on one surface of the base member 51*a*, it is possible to produce a printed material which can be visually recognized from both sides. Further, like in the first preferred embodiment, since the thickness of the light blocking layer 532 of the printed material 5 is uneven in conformity with the undulation of the first image layer 52, it is possible to prevent or suppress the undulation of the first image layer 52 from being visually recognized from the side of the second image layer 54.

Though the preferred embodiments of the present invention have been discussed above, the present invention is not limited to the above-discussed preferred embodiments, but allows various variations. In the printers 1 and 1*a*, when the light blocking layer 532 may be thick, the light blocking layer 532 may be formed by using the negative image data of the first image layer 52. Further, the negative image data may be generated by inverting the halftone image data generated from the first image layer data.

In the above-discussed preferred embodiments, light cyan and light magenta may be used, as discussed earlier, and another special color may be used. Ink having other curability such as thermosetting property (heat curability) or the like may be used as the color ink and the white ink. Even when curable ink which is likely to cause undulation in the image layer is used, by making the thickness of the intermediate layer 53 uneven in conformity with the undulation of the first image layer 52, it is possible to effectively prevent the undulation of the first image layer 52 from appearing in the second image layer 54. In the intermediate layer 53, a background layer of the other color may be provided, instead of the white background layer. The light blocking layer 532 may be formed as a black layer by using only the ink of black (K).

When the change in the colors of the first image layer 52 and the second image layer 54 is within tolerance, only the light blocking layer 532 of gray may be formed as the intermediate layer 53. Since the light blocking layer 532 of gray is formed as at least part of the intermediate layer 53 (i.e., as a layer included in the intermediate layer 53), it is possible to easily extinguish the undulation of the first image layer 52 with one main scan using the ink of the four colors even when the undulation cannot be cancelled by the application of ink of one color.

In the first to third preferred embodiments, a mechanism for moving the stage 21 in the main scan direction and/or a mechanism for moving the head unit 3 in the subscan direction may be provided. The stage 21 or the head unit 3 may move in the main scan direction and the subscan direction. Thus, a moving mechanism for moving the base member 51 relatively to the heads 31 to 35 may be achieved with any constitution. This is also applied to the fourth preferred embodiment.

In each of the heads 31 to 35, a plurality of discharge ports may be arranged in a direction inclined toward the Y direction only if the plurality of discharge ports are provided at almost a regular pitch in a direction in parallel with the base member 51 and perpendicular to the scan direction. Further, in each of the heads 31 to 35, the plurality of discharge ports may be arranged in a staggered manner. The constitution of the head of the head unit 3 is not limited to those shown in the above-discussed preferred embodiments, and a head for any one color may be constituted of a combination of a plurality of heads. In order to form a thick white background layer, for example, a plurality of heads for the white ink may be arranged in the X direction.

In the above-discussed preferred embodiments, by assigning any one number of one to three or more as a pixel value to each pixel in the halftone image data, control may be so made as to discharge dots of ink having a plurality of sizes. In this case, the threshold matrix is prepared for each size of dot.

The technique for cancelling the undulation of the first image layer 52 by making the thickness of the intermediate layer 53 or 53*a* uneven may be used for plate printing or electrophotographic printing.

The constitutions in the above-discussed preferred embodiments and variations may be combined as appropriate as long as no inconsistency is caused.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2010-218101 filed in the Japan Patent Office on Sep. 29, 2010 and Japanese Patent Application No. 2011-163463 filed in the Japan Patent Office on Jul. 26, 2011, the entire disclosures of which are incorporated herein by reference.

REFERENCE SIGNS LIST

1, 1*a* printer
4 controller
5, 5*a* printed material
11 image forming part
12, 12*a* base member moving mechanism
45 intermediate layer data generator
51, 51*a* base member
52 first image layer
53, 53*a* intermediate layer
54 second image layer
523 upper surface (of first image layer)
531 lower white background layer
532 light blocking layer
533 upper white background layer
533*a* upper surface (of upper white background layer)
533*b* upper surface (of intermediate layer)
S13 to S15, S14*a*, S141, S142 step

The invention claimed is:

1. A printer, comprising:

an image forming part for discharging droplets of curable ink toward a transparent base member;

a base member moving mechanism for moving said transparent base member relatively to said image forming part; and a controller for controlling said image forming part and said base member moving mechanism; wherein a first image layer having undulation is formed on a transparent base member in accordance with first image layer data, an intermediate layer whose surface is flat is formed on said first image layer in accordance with intermediate layer data, and a second image layer is formed on said intermediate layer in accordance with second image layer data by a control of said controller, said controller comprises an intermediate layer data generator for generating said intermediate layer data indicating an uneven thickness in conformity with said undulation, from said first image layer data, said first image layer data is data indicating an application amount of ink of each color at each position on said transparent base member, said intermediate layer data generator generates said intermediate layer data by subtracting the total application amount of ink of the colors at said each position, which is indicated by said first image layer data, from a preset value, and said preset value is smaller than the maximum total application amount of ink at said each position.

2. The printer according to claim 1, wherein said first image layer data, said intermediate layer data, and said second image layer data are data immediately before rasterization for discharge of ink is performed, an image represented by one image layer data out of said first image layer data and said second image layer data consists of image layer area(s) representing application of ink at each position and transparent area(s) representing non-application of ink at each position, said intermediate layer data generator generates said intermediate layer data by using said one image layer data, and an image represented by each of said intermediate layer data and the other image layer data represents non-application of ink at each position in area(s) which overlaps said transparent area(s) in said image represented by said one image layer data.

3. The printer according to claim 1, wherein said first image layer data, said intermediate layer data, and said second image layer data are data immediately before rasterization for discharge of ink is performed, an image represented by said first image layer data consists of image layer area(s) representing application of ink at each position and transparent area(s) representing non-application of ink at each position, an image represented by said second image layer data consists of image layer area(s) representing application of ink at each position and transparent area(s) representing non-application of ink at each position, said intermediate layer data generator generates said intermediate layer data by using said first image layer data and said second image layer data, and an image represented by said intermediate layer data represents non-application of ink at each position in area(s) which overlaps said transparent area(s) in said image represented by said first image layer data and said transparent area(s) in said image represented by said second image layer data.

4. The printer according to claim 1, wherein said image forming part is capable of discharging at least droplets of normal ink of one color and droplets of light ink which has a color similar to said one color of said normal ink and has a density lower than that of said normal ink, a light blocking layer is formed as a layer included in said intermediate layer, and said light blocking layer contains said normal ink and does not contain said light ink.

5. The printer according to claim 1, wherein said transparent base member is web-like.

6. A printer comprising:

an image forming part for discharging droplets of curable ink toward a transparent base member;

a base member moving mechanism for moving said transparent base member relatively to said image forming part; and a controller for controlling said image forming part and said base member moving mechanism; wherein a first image layer having undulation is formed on a transparent base member in accordance with first image layer data, an intermediate layer whose surface is flat is formed on said first image layer in accordance with intermediate layer data, and a second image layer is formed on said intermediate layer in accordance with second image layer data by a control of said controller, said controller comprises an intermediate layer data generator for generating said intermediate layer data indicating an uneven thickness in conformity with said undulation, from said first image layer data, said first image layer data is data indicating an application amount of ink of each color at each position on said transparent base member, said intermediate layer data generator generates said intermediate layer data by subtracting said application amount of ink of said each color at said each position, which is indicated by said first image layer data, from a preset value for said each color, and said preset value is smaller than the maximum application amount of ink of said each color at said each position.

7. The printer according to claim 6, wherein said first image layer data, said intermediate layer data, and said second image layer data are data immediately before rasterization for discharge of ink is performed, an image represented by one image layer data out of said first image layer data and said second image layer data consists of image layer area(s) representing application of ink at each position and transparent area(s) representing non-application of ink at each position, said intermediate layer data generator generates said intermediate layer data by using said one image layer data, and an image represented by each of said intermediate layer data and the other image layer data represents non-application of ink at each position in area(s) which overlaps said transparent area(s) in said image represented by said one image layer data.

8. The printer according to claim 6, wherein said first image layer data, said intermediate layer data, and said second image layer data are data immediately before rasterization for discharge of ink is performed, an image represented by said first image layer data consists of image layer area(s) representing application of ink at each position and transparent area(s) representing non-application of ink at each position, an image represented by said second image layer data consists of image layer area(s) representing application of ink at each position and transparent area(s) representing non-application of ink at each position, said intermediate layer data generator generates said intermediate layer data by using said first image layer data and said second image layer data, and an image represented by said intermediate layer data represents non-application of ink at each position in area(s) which overlaps said transparent area(s) in said image represented by said first image layer data and said transparent area(s) in said image represented by said second image layer data.

9. The printer according to claim 6, wherein said image forming part is capable of discharging at least droplets of normal ink of one color and droplets of light ink which has a color similar to said one color of said normal ink and has a density lower than that of said normal ink, a light blocking layer is formed as a layer included in said intermediate layer, and said light blocking layer contains said normal ink and does not contain said light ink.

10. The printer according to claim 6, wherein said transparent base member is web-like.

11. A printer comprising:

an image forming part for discharging droplets of curable ink toward a transparent base member;

a base member moving mechanism for moving said transparent base member relatively to said image forming part; and a controller for controlling said image forming part and said base member moving mechanism; wherein a first image layer having undulation is formed on a transparent base member in accordance with first image layer data, an intermediate layer whose surface is flat is formed on said first image layer in accordance with intermediate layer data, and a second image layer is formed on said intermediate layer in accordance with second image layer data by a control of said controller, said controller comprises an intermediate layer data generator for generating said intermediate layer data indicating an uneven thickness in conformity with said undulation, from said first image layer data, a background layer and a light blocking layer are formed in this order on said first image layer as layers included in said intermediate layer by a control of said controller, said first image layer data is data indicating an application amount of ink at each position on said transparent base member, background layer data used for forming said background layer indicates an application amount of ink which is constant for said each position, said intermediate layer data generator specifies a position as an offset target position, said application amount of ink at said position in said first image layer data is smaller than that at an adjacent position by a predetermined value or more; and generates light blocking layer data to be used for forming said light blocking layer, by decreasing a value at said offset target position in subtraction image data which is generated by subtracting said application amount of ink at said each position, which is indicated by said first image layer data, from a preset value.

12. The printer according to claim 11, wherein said first image layer data, said intermediate layer data, and said second image layer data are data immediately before rasterization for discharge of ink is performed, an image represented by one image layer data out of said first image layer data and said second image layer data consists of image layer area(s) representing application of ink at each position and transparent area(s) representing non-application of ink at each position, said intermediate layer data generator generates said intermediate layer data by using said one image layer data, and an image represented by each of said intermediate layer data and the other image layer data represents non-application of ink at each position in area(s) which overlaps said transparent area(s) in said image represented by said one image layer data.

13. The printer according to claim 11, wherein said first image layer data, said intermediate layer data, and said second image layer data are data immediately before rasterization for discharge of ink is performed, an image represented by said first image layer data consists of image layer area(s) representing application of ink at each position and transparent area(s) representing non-application of ink at each position, an image represented by said second image layer data consists of image layer area(s) representing application of ink at each position and transparent area(s) representing non-application of ink at each position, said intermediate layer data generator generates said intermediate layer data by using said first image layer data and said second image layer data, and an image represented by said intermediate layer data represents non-application of ink at each position in an area(s) which overlaps said transparent area(s) in said image represented by said first image layer data and said transparent area(s) in said image represented by said second image layer data.

14. The printer according to claim 11, wherein said image forming part is capable of discharging at least droplets of normal ink of one color and droplets of light ink which has a color similar to said one color of said normal ink and has a density lower than that of said normal ink, said light blocking layer is formed as a layer included in said intermediate layer, and said light blocking layer contains said normal ink and does not contain said light ink.

15. The printer according to claim 11, wherein said transparent base member is web-like.

* * * * *